US005565007A

United States Patent [19]

Schrell et al.

[11] Patent Number: 5,565,007

[45] Date of Patent: Oct. 15, 1996

[54] AMINATION OF RAYON

[75] Inventors: Andreas Schrell, Frankfurt; Werner H. Russ, Flörsheim; Bernd Huber, Kelheim, all of Germany

[73] Assignee: Hoechst Aktiengesellschaft, Germany

[21] Appl. No.: 440,997

[22] Filed: May 15, 1995

[30] Foreign Application Priority Data

May 17, 1994 [DE] Germany ..... 44 17 211.7
Jun. 22, 1994 [DE] Germany ..... 44 21 740.4

[51] Int. Cl.[6] ..... D06P 3/62; D06P 3/66; D01F 2/24

[52] U.S. Cl. ..... 8/538; 8/549; 8/673; 8/680; 8/920; 8/921; 8/188; 8/189; 8/196; 264/189; 264/194; 264/195

[58] Field of Search ..... 106/165, 168; 8/538, 549, 921, 920, 188, 189, 196; 264/189, 194, 195

[56] References Cited

U.S. PATENT DOCUMENTS

| | | | |
|---|---|---|---|
| 3,305,377 | 2/1967 | Mahomed . | |
| 3,685,953 | 8/1972 | Cuvelier et al. . | |
| 3,778,225 | 12/1973 | Cuvelier et al. . | |
| 3,793,419 | 2/1974 | Steinlin et al. . | |
| 3,905,954 | 9/1975 | Jones et al. . | |
| 4,196,282 | 4/1980 | Franks et al. | 536/56 |
| 4,806,126 | 2/1989 | Sternberger et al. . | |
| 4,988,365 | 1/1991 | Sternberger et al. . | |
| 5,189,152 | 2/1993 | Hinterholzer et al. | 536/56 |
| 5,348,557 | 9/1994 | von der Eltz et al. . | |

FOREIGN PATENT DOCUMENTS

| | | |
|---|---|---|
| 2084585 | 6/1993 | Canada . |
| 0284010 | 9/1988 | European Pat. Off. . |
| 0359188 | 3/1990 | European Pat. Off. . |
| 0546476 | 6/1993 | European Pat. Off. . |
| 0590397 | 4/1994 | European Pat. Off. . |
| 0680956 | 5/1930 | France . |
| 1130231 | 2/1957 | France . |
| 0069329 | 10/1958 | France . |
| 1469062 | 3/1969 | Germany . |
| 1942742 | 3/1970 | Germany . |
| 1948487 | 4/1970 | Germany . |
| 2921314 | 12/1979 | Germany . |
| 0141556 | 10/1930 | Switzerland . |
| 0177814 | 9/1935 | Switzerland . |
| 0558925 | 8/1977 | U.S.S.R. . |
| 1387265 | 3/1975 | United Kingdom . |

OTHER PUBLICATIONS

Melliand Textilberichte, Nr. 6, *Uber die Aminierung von Cellulosefasern und deren physikalisches und chemisches Verhalten bei der Textilveredlung*, pp. 641–647 (1964).

*Primary Examiner*—Margaret Einsmann
*Attorney, Agent, or Firm*—Connolly & Hutz

[57] ABSTRACT

Modified rayon is produced by adding a modifier to a cellulose solution and spinning fibers from the solution, or by adding a modifier to an alkali cellulose solution or material, xanthating and spinning fibers by the viscose spinning process, wherein the modifier is an amine of the formula (1a), (1b), (1c), (1d) or (1e)

(1a)

$$(B)_p-\underset{\underset{(OH)_n}{|}}{alk}-(ER)_m \quad (1b)$$

$$H_2N\text{-alkylen-}(ER)_m \quad (1c)$$

(1d)

$$ClCH_2-CH(OH)-CH_2-\overset{(+)}{N}R_2^1R^2Z^{(-)} \quad (1e)$$

The modified rayon produced in this way can be dyed with reactive dyes without addition of electrolyte salt or alkali and have significantly more affinity than conventional viscose fibers.

12 Claims, No Drawings

AMINATION OF RAYON

The present invention relates to the field of the textile dyeing of viscose fibers.

Viscose fibers, also known as regenerated cellulose fibers, have essentially the same dyeing characteristics as cotton fibers. At present, the dyeing of natural or regenerated cellulosic fibers requires alkali-donating agents and also electrolytes in order that satisfactory fixation results may be obtained with reactive dyes. It is precisely these needed additions, however, which are ecologically unacceptable. The future will therefore increasingly belong to regenerated cellulose fibers which are dyeable without salt and alkali. One possibility is to modify viscose fibers in such a way that they resemble animal fibers, such as wool or silk, in their chemical behavior and can be dyed under neutral conditions with anionic dyes without further salt or alkali additions.

Modifications of viscose have already been described in the literature. U.S. Pat. No. 3,793,419 for instance, describes a process for producing viscose fibers having modified dyeing characteristics. However, the process is extremely complicated and uneconomical. In addition, long-chain polyamineamides are used, which severely alter the native character of the fiber because of their predominantly lipophilic structure. This is evident for example from the use of dyes which are otherwise not suitable for dyeing cellulose material.

Similarly, U.S. Pat. No. 3,305,377 describes aminalized fibers. The additions are aminoethyl- and diethylaminoethylcelluloses in high concentration, and the dyeing is done exclusively with acid dyes. Accordingly, the wash fastness does not meet present-day requirements.

U.S. Pat. No. 4,806,126, U.S. Pat. No. 4,988,365 and CA-A-2084585 describe various amino-containing compounds for use as agents for pretreating the surface of cellulose fiber textiles before dyeing. The disadvantage of such processes is an additional process step and yellowing of the viscose fiber in the course of the modification.

French Patent 1,130,231 describes the reaction of alkali cellulose with N,N-diethyl-3-amino-1,2-epoxypropane. The disadvantages with this process are the high levels of active substance, based on the alkali cellulose used, and the long residence times needed for reaction. A particularly negative aspect is that the amine used will polymerize under the stated conditions, and does in fact tend to polymerize even in substance, and thus will be unavailable for modifying cellulose. The polymer produced, moreover, has a lasting adverse effect on the subsequent xanthation and the spinning process, in the course of which the spun thread tends to break again and again.

On using haloalkylamines, as described in the French Patent 680,956, it is found that the reactivity of the amine is not sufficient to bring about a covalent bond between the amine and the fiber.

It is an object of the present invention to provide modified viscose fibers in order that textiles composed of such fibers may be dyed with reactive dyes without salt and alkali and the aforementioned disadvantages of the prior art may be avoided.

It has been found that this object is surprisingly achieved by admixture of below-defined amino compounds to alkali-digested cellulose and subsequent xanthation or by admixture to a cellulose solution.

The present invention accordingly provides modified rayon produced by adding a modifier to a cellulose solution and spinning fibers from the solution, or by adding a modifier to an alkali cellulose solution or material, xanthating and spinning fibers by the viscose spinning process, wherein the modifier is an amine of the formula (1a), (1b), (1c), (1d) or (1e)

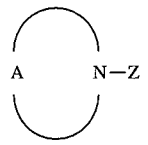

(1a)

$$(B)_p-\underset{\underset{(OH)_n}{|}}{alk}-(ER)_m \quad (1b)$$

$$H_2N\text{-alkylen-}(ER)_m \quad (1c)$$

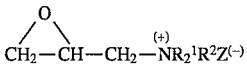

(1d)

$$ClCH_2-CH(OH)-CH_2-\overset{(+)}{N}R_2{}^1R^2Z^{(-)} \quad (1e)$$

where

Z is hydrogen, $C_1$–$C_4$-alkyl with or without substitution by 1 or 2 OH groups, or alkylen-(ER)-$_m$;

ER is an ester group;

A and N together with 1 or 2 alkylene groups of 1 to 4 carbon atoms form the radical of a heterocyclic ring wherein A is an oxygen atom or a group of the formula (a), (b) or (c)

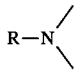

(a)

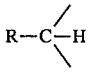

(b)

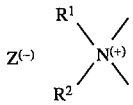

(c)

where

R is a hydrogen atom or an amino group or an alkyl group of 1 to 6 carbon atoms which may be substituted by 1 or 2 substituents selected from the group consisting of amino, sulfo, hydroxyl, sulfato, phosphato and carboxyl, or an alkyl group of 3 to 8 carbon atoms which is interrupted by 1 or 2 hetero groups selected from the groups —O— and —NH— and may be substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is an amino group of the formula $H_2N$— or an amino or ammonium group of the formula (d) or (e)

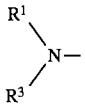

(d)

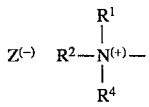

(e)

where $R^1$, $R^2$ and $Z^{(-)}$ are each as defined above, $R^3$ is methyl or ethyl, and $R^4$ is hydrogen, methyl or ethyl;

p is 1 or 2; alkylene is a straight-chain or branched alkylene radical of 2 to 6 carbon atoms which may be substituted by 1 or 2 hydroxyl groups, or is a straight-chain or branched alkylene radical of 3 to 8 carbon atoms which is interrupted by 1 or 2 hereto groups selected from the groups —O— and —NH—;

alk is a straight-chain or branched alkylene radical of 2 to 6 carbon atoms, or is a straight-chain or branched alkylene radical of 3 to 8 carbon atoms which is interrupted by 1 or 2 hetero groups selected from the groups —O— and —NH—, m is 1 or 2;

n is from 1 to 4; and where the amino, hydroxyl and ester groups can be bonded to a primary, secondary or tertiary carbon atom of the alkylene radical;

or wherein the modifier is 2-oxo-1,3-oxazolidine, 4-aminomethyl-2-oxo-1,3-oxazolidine, 5-aminomethyl-2-oxo-1,3-oxazolidine, 4-(trimethylammoniomethyl)-2-oxo-1,3-oxazolidine chloride, 5-(trimethylammoniomethyl)-2-oxo-1,3-oxazolidine chloride or 1-(trimethylammoniomethyl)ethylene carbonate chloride.

Of particular suitability are modifiers where the ester group is a sulfato or phosphato group or is a lower alkanoyl group, a phenylsulfonyloxy group or a phenylsulfonyloxy group substituted in the benzene nucleus by substituents selected from the group consisting of carboxyl, lower alkyl, lower alkoxy and nitro.

Suitable modifiers are in particular the compounds N-(β-sulfatoethyl)piperazine, N-[β-(β'-sulfatoethoxy)ethyl]piperazine, N-(γ-sulfato-β-hydroxypropyl)piperidine, N-(β-sulfato-β-hydroxypropyl)pyrrolidine, N-β-sulfatoethylpiperidine, 2-sulfato-3-hydroxy-1-aminopropane, 3-sulfato-2-hydroxy-1-aminopropane, 1-sulfato-3-hydroxy-2-aminopropane, 3-hydroxy-1-sulfato-2-aminopropane, 2,3-disulfato-1-aminopropane or 1,3-disulfato-2-aminopropane, a derivative of these compounds with one of the ester groups mentioned above instead of the sulfato group, or N-(2-sulfatoethyl)piperazine sulfate. Also suitable are glycidyltrimethylammonium chloride, aziridine, N-hydroxyethylaziridine and oxazolidinone.

Also suitable for modifying the alkali celluloses are compounds with α-chloro-β-hydroxy substitution, preferably 3-chloro-2-hydroxypropyl, as the reactive radical on the amine component. Reactive for the purposes of the present invention further includes in general those moieties which are capable of reaction with the hydroxyl groups of the cellulose to form a covalent chemical bond.

The alkaline digestion of the cellulose is carried out in a conventional manner, for example with 20% strength by weight sodium hydroxide solution at 20° to 40° C., the product obtained being alkali cellulose. Afterwards the excess alkali, for example the sodiumhydroxide solution, is removed, for example by squeezing or centrifuging it off.

The modifiers used for the process of the invention are incorporated either in an alkaline medium or in substance directly into the alkali cellulose material and display good compatibility. The addition is effected in an amount of 1 to 20% by weight, preferably 1 to 8% by weight, based on the cellulose content of the alkali cellulose material.

After addition of the modifiers the reaction mixture has to "ripen" for 15 minutes to 6 hours, preferably 1 to 3 hours, preferably at temperatures of 40° to 80° C. Subsequently the reaction mixture is reacted in a conventional manner with carbon disulfide to form cellulose xanthate, advantageously at temperatures of 5° to 25° C. for 0.5 to 2 hours. If necessary, the excess carbon disulfide is removed, preferably distilled off and regenerated. The viscose modified in this way is advantageously spun as fibers into an acidic coagulation bath.

There is no deterioration in the filterability of viscose compared with addition-free samples, so that no plugging of the spinneret is observed in the course of the spinning process. The forming of the viscose is carried out by customary and known methods, for example by means of spinnerets and a subsequent coagulation bath with or without further aftertreatment baths.

The process of spinning gives fibers which are dyeable according to the present invention using low-electrolyte or completely electrolyte-free and low-alkali or alkali-free dyeing liquors (including print pastes and inkjet liquids). Low-electrolyte dyeing liquors for the purposes of the present invention are dyeing liquors having an electrolyte content of below 15 g/l and low-alkali dyeing liquors are dyeing liquors having a pH of not more than 8.5.

The fibers mentioned have significantly more affinity for reactive and direct dyes than conventional viscose fibers, but otherwise hardly differ from conventional viscose fibers in the otherwise desired properties, such as luster and hand.

The textile modified fiber material which is used for subsequent dyeing processes can be present in all processing states, for instance as yarn, staple, slubbing and piece goods (fabrics).

The amination of the cellulose fibers according to the present invention probably involves a chemical reaction between the hydroxyl groups of the cellulose and the modifier with the formation of covalent bonds.

The aminated textile fiber materials are dyed according to the present invention analogously to known processes for dyeing and printing fiber materials with water-soluble textile dyes and through the use of the known temperature ranges and customary dyestuff quantities, except that the dyebaths, padding liquors, print pastes and inkier formulations require no quantitative addition of alkaline compounds, as customary for fixing fiber-reactive dyes, nor customary additions of electrolyte salts. Dyeing of the modified viscose according to the present invention takes place at between pH 4 and pH 8.5, depending on the type of dye. If commercially available textile dyes are used, it is normal for salt to be present in an amount from 0.01 to 0.5% by weight, based on the dyeing liquor. Without the amination of the cellulose fibers according to the present invention, this salt content would be too low for successful dyeing by a factor of 50 to 1000.

Suitable dyeing processes include for example the various exhaust processes, such as dyeing on the jigger or on the reel beck or dyeing from long or short liquor, dyeing in jet dyeing machines, dyeing by short-time pad-batch processes or by a pad-superheated stem fixation process. Suitable printing processes include conventional printing techniques, including inkier printing and transfer printing.

The dyes which are used for dyeing the modified cellulose are generally anionic in nature, in particular reactive dyes and also acid or direct dyes.

Of particular suitability are the fiber-reactive textile dyes which are capable of reacting with hydroxyl groups, for example of cellulose, or amino and thiol groups, for example of wool and silk, of synthetic polymers, such as polyamides, or else the celluloses aminated according to the present invention, to form a covalent bond. Suitable fiber-reactive components on the textile dyes include in particular sulfatoethylsulfonyl, vinylsulfonyl, chlorotriazinyl, fluorotriazinyl and also combinations thereof.

Suitable reactive dyes for dyeing or printing viscose fibers modified according to the present invention include all water-soluble, preferably anionic, dyes which preferably have one or more sulfo and/or carboxyl groups and which contain fiber-reactive groups. They can belong not only to the class of the fiber-reactive dyes but also to the class of the azoic dyes, the class of the direct dyes, the class of the vat dyes and the class of the acid dyes, which can be for example azo dyes, copper complex, cobalt complex and chromium complex azo dyes, copper and nickel phthalocyanine dyes, anthraquinone, copper formazan, azomethine, nitroaryl, dioxazine, triphendioxazine, phenazine and stilbene dyes. These dyes have been numerously described in the literature, for example in EP-A-0 513 656, and are in every respect conversant to the person skilled in the art.

Suitable acid or direct dyes for dyeing or printing cellulose fibers modified according to the present invention include for example the diamine dyes, ®Sirius Light Fast dyes, ®Alphanoi dyes, ®Cotonerol dyes and ®Duasyn dyes, e.g. C.I. Acid Black 27 (C.I. No. 26 310), C.I. Acid Black 35 (C.I. No. 26 320), C.I. Acid Blue 113 (C.I. No. 26 360), C.I. Direct Orange 49 (C.I. No. 29 050), C.I. Direct Orange 69 (C.I. No. 29 055), C.I. Direct Yellow 34 (C.I. No. 29 060), C.I. Direct Red 79 (C.I. No. 29 065), C.I. Direct Yellow 67 (C.I. No. 29 080), C.I. Direct Brown 126 (C.I. No. 29085), C.I. Direct Red 84 (C.I. No. 35 760), C.I. Direct Red 80 (C.I. No. 35 780), C.I. Direct Red 194 (C.I. No. 35 785), C.I. Direct Red 81 (C.I. No. 28 160), C.I. Direct Red 32 (C.I. No. 35 790), C.I. Direct Blue 162 (C.I. No. 35 770), C.I. Direct Blue 159 (C.I. No. 35 775), C.I. Direct Black 162:1 and C.I. Direct Violet 9 (C.I. No. 27 885).

A direct dye ink formulation customary in inkjet printing preferably contains:

| | |
|---|---|
| 5 to 10% by weight of | direct dye |
| 3 to 8% by weight of | a nonionic wetting agent (e.g. ® Genapol C, O, X, PF grades) |
| 2 to 10% by weight of | diethylene glycol, propylene glycol or similar glycols or glycol ethers |
| 0.1 to 5% by weight of | glycerol, di- or tetra-methylurea |
| 70 to 89.9% by weight of | distilled water. |

Unless otherwise stated, parts in the examples which follow are by weight.

EXAMPLE 1

60 parts of a commercial cellulose are admixed with 1000 parts of 18% strength sodium hydroxide solution and mixed for 45 minutes. Afterwards the excess sodium hydroxide solution is filtered off with suction on a glass frit. The remaining moist, strongly alkaline alkali cellulose cake is then slurried up with a solution containing 30 parts of N-(2-sulfatoethyl)piperazine sulfate and 300 parts of 18% strength sodium hydroxide solution and again filtered with suction. The alkali cellulose thus produced is ripened at 80° C. for 60 minutes, cooled down to 15° C. and admixed with 20 parts of carbon disulfide so that the temperature does not exceed 30° C. After a reaction time of 45 minutes the yellowish mass is introduced into 450 parts of 4% strength sodium hydroxide solution, and the xanthate is stirred to form a homogeneous, viscous solution.

After devolatilization the spinning solution is spun by customary viscose spinning processes into a bath which contains sulfuric acid, sodium sulfate and zinc sulfate to form fibers, which are stretched in acid baths, cut, washed, spinfinished and dried.

10 parts of these dry viscose fibers are then admixed in a dyeing apparatus with 100 parts of water The temperature is raised to 60° C. and a total of 0.1 part of a 50% strength electrolyte(predominantly sodium chloride)-containing dye powder of the formula, known from DE-A-19 43 904 is metered in over a period of 30 minutes. Following a further liquor circulation period of 5 minutes the remaining, colorless liquor is dropped and the material is conventionally washed and dried. The result obtained is a strong and deep red dyeing having very good use fastness properties.

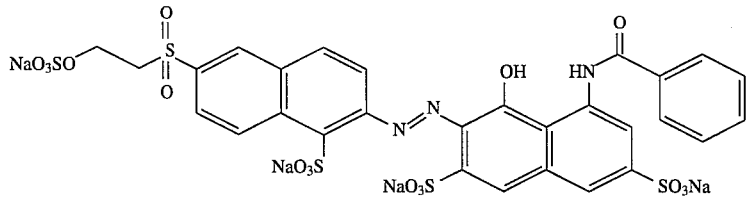

EXAMPLE 2

10 parts of the viscose fibers modified as described in Example 1 are transferred into a dyeing apparatus and treated in a liquor ratio of 10:1 with an aqueous liquor which, based on the weight of the dry fibers, contains in solution 0.1 part of a reactive dye of the formula, known from DE-A-24 12 964

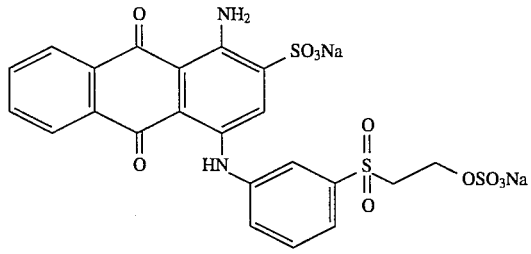

The fiber mixture is dyed at 60° C. for 30 minutes. The dyeing thus produced is further treated by rinsing and soaping in a conventional manner. The result obtained is a deep blue dyeing having very good use fastness properties.

EXAMPLE 3

100 parts of moist, strongly alkaline alkali cellulose cake described under Example I are admixed with 3 parts of an aqueous solution containing 50 parts of 3-chloro-2-hydroxypropyltrimethylammoniumchloride and 50 parts of water by spraying. Afterwards the directions of Example 1 are followed. After devolatilization the spinning solution is spun by customary viscose spinning processes into a bath containing sulfuric acid, sodium sulfate and zinc sulfate to form fibers, which are stretched in acid baths, cut, washed, spinfinished and dried.

Weaving thus gives a textile viscose fabric which can be further processed directly in a pad-dyeing process. For this the fabric has applied to it at 25° C. an aqueous dye solution which, per 1000 parts by volume, contains in solution 20 parts of the dye of the formula

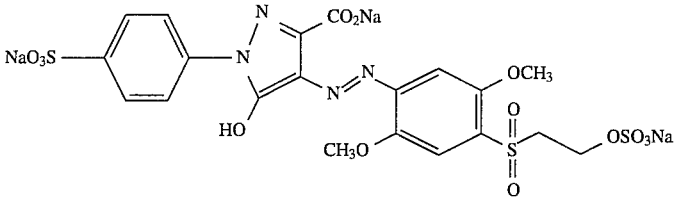

known from EP-A-0 158 233, Example 1, and 3 parts of a commercial nonionic wetting agent, by means of a pad-mangle to a liquor pickup of 80%, based on weight of fiber. The fabric padded with the dye solution is wound onto a hatching roller, wrapped in plastic film, left at from 40° to 50° C. for 4 hours and then rinsed with cold and hot water, which may contain a commercial surfactant, and if necessary subsequently rinsed once more with cold water and dried.

The result obtained is a strong level yellow dyeing which has good all round fastness properties, especially good rub and light fastness properties.

EXAMPLE 4

Example 1 is repeated and the alkali cellulose obtained is sprayed with 4 parts of an alkaline solution of 50 parts of glycidyltrimethylammonium chloride in 50 parts of 18% strength sodium hydroxide solution. The cellulose obtained is further treated as described under Example 1. Devolatilization, spinning, stretching, cutting, washing and drying gives a fiber which can be dyed by a conventional exhaust process. To this end 20 parts of the pretreated viscose fiber are treated in a dyeing apparatus with 200 parts of an aqueous liquor which, based on weight of fiber, contains 1.5% of the reactive dye of the formula

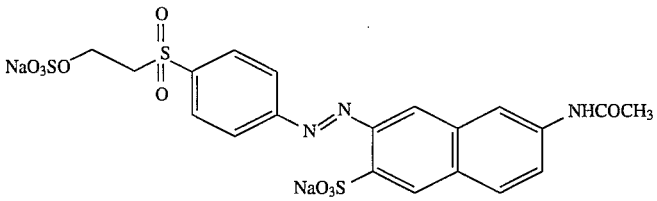

known from EP-A-0 061 151, Example 4, in commercial form and consistency. The fiber is dyed with this liquor at 60° C. for 30 min. The dyeing thus obtained is further treated by rinsing and soaping in a conventional manner. The result obtained i a vivid orange dyeing having the customary good fastness properties of reactive dyes.

EXAMPLE 5

An alkali cellulose produced as described in Example 4 is used to produce, by the process steps customary for spinning viscoses, a modified viscose fiber material which can be reactively dyed in an exhaust process without salt or alkali. To this end, 30 parts of viscose fiber are wound to a package and the yarn is treated in a yarn dyeing apparatus which contains 450 parts (based on weight of fiber) of a liquor which contains 0.6 parts, based on the initial weight of the goods, of an electrolyte(predominantly sodium chloride)-containing dye of formula

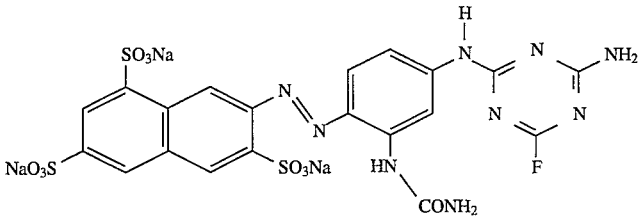

known from DE-A-28 40 380, Example 1, and heated to 60° C., the liquor being pumped alternately in to out and out to in. After 60 min at this temperature the liquor is dropped, and the dyeing obtained is rinsed and washed under the customary conditions. The result obtained is a level yellow fiber having the generally good fastness properties of reactive dyes.

Further examples

Example 4 is repeated using the reactive dyes listed hereinafter, which are applied by conventional processes but without alkali or salt additions. The results obtained are similar.

6)
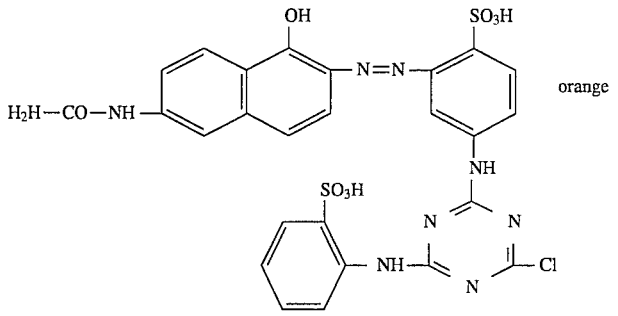
orange
7)
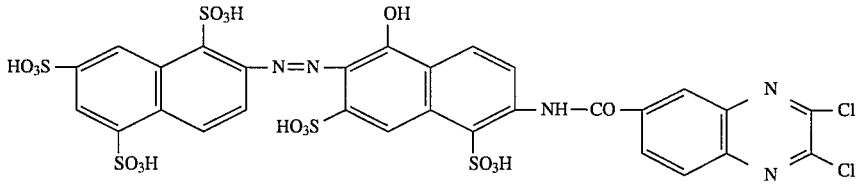
orange
8)
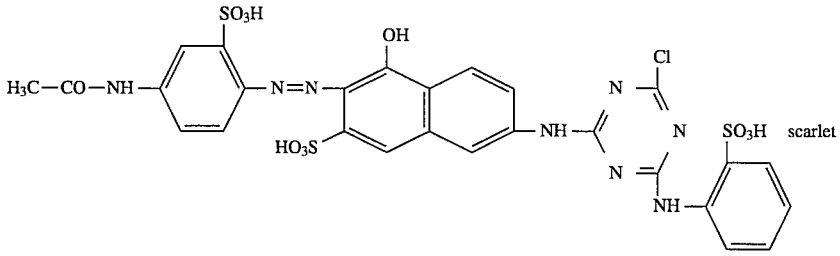
scarlet
9)
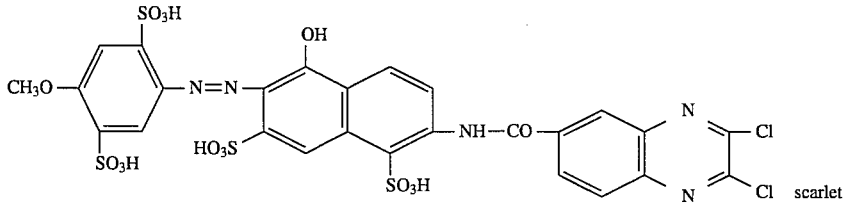
scarlet
10)
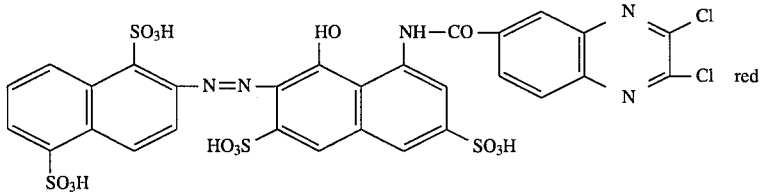
red
11)
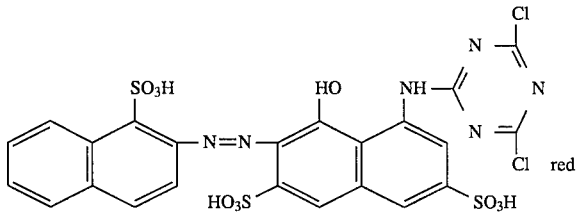
red
12)
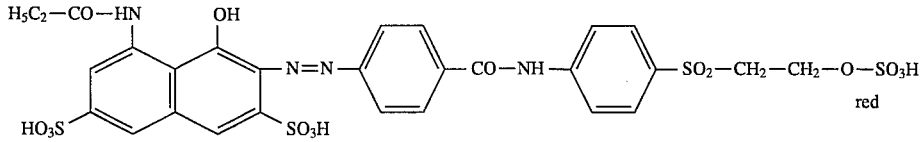
red -continued

13)

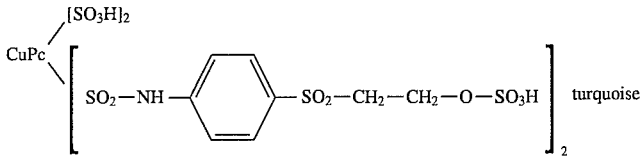

CuPc = copper phthalocyanine

14)

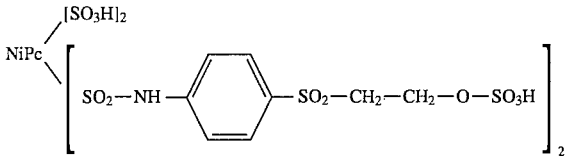

NiPc = nickel phthalocyanin

15)

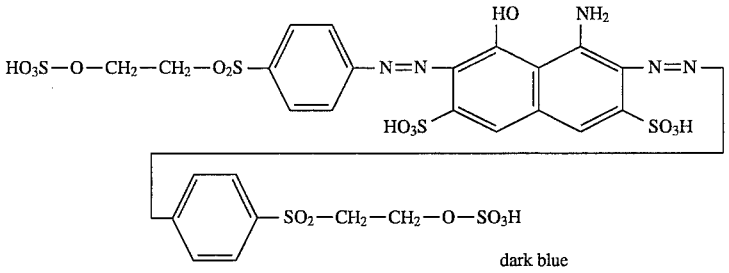

dark blue (16)

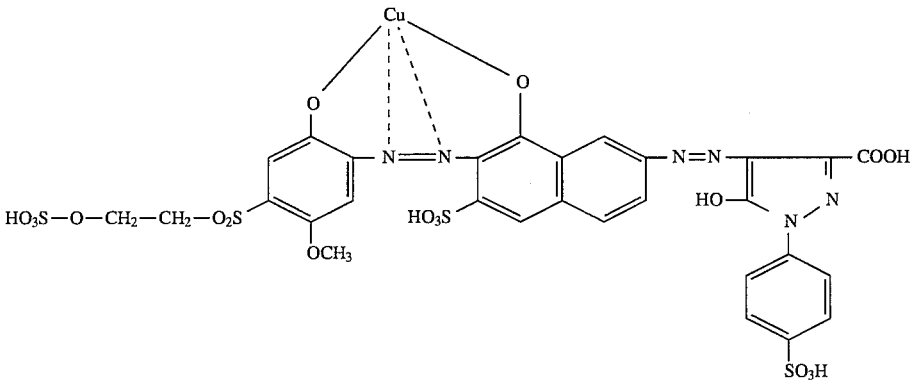

anthracite

17)

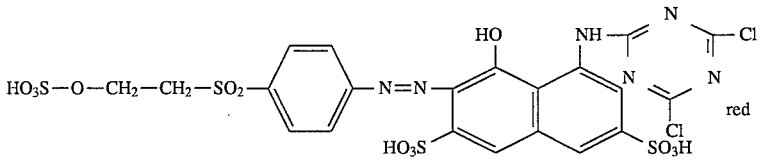

red

EXAMPLE 18

A viscose modified as in Example 1 is passed by means of one or two rolls for guiding and tensioning the fabric underneath an inkier printing head and printed with aqueous solutions of direct dyes. The printer operates according to the drop on demand principles and the ink droplets are produced by the piezo principle. To obtain multicolored prints, a four-color print is carried out with the primary colors of subtractive color mixing (yellow, cyan, magenta and black). The cyan dye used is C.I. Direct Blue 199, the yellow dye used is C.I. Direct Yellow 67, the magenta dye used is C.I. Direct Red 81 and the black component used is C.I. Acid Black 27. The printed fabric is then steamed for 2 minutes and then conventionally rinsed and soaped. The resulting print has good general fastness properties.

Further examples

Example 3 is repeated using the below-listed dyes. Similar results are obtained.

| | |
|---|---|
| C.I. Direct Violet 9 | C.I. No. 27885 |
| C.I. Direct Brown 126 | C.I. No. 29085 |
| C.I. Direct Orange 69 | C.I. No. 29055 |
| C.I. Acid Blue 113 | C.I. No. 26360 |
| C.I. Acid Blue 40 | C.I. No. 62125 |

What is claimed is:

1. Modified rayon fiber produced by adding a modifier to a cellulose solution and spinning fibers from the solution, or by adding a modifier to an alkali cellulose solution or material, xanthating and spinning fibers by the viscose spinning process, wherein the modifier is an amine of the formula (1a), (1b), (1d) or (1e)

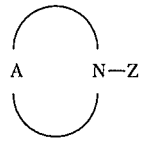

(1a)

$$(B)_p-\underset{\underset{(OH)_n}{|}}{alk}-(ER)_m \quad (1b)$$

$$CH_2-\overset{O}{\triangle}-CH-CH_2-\overset{(+)}{N}R_2{}^1R^2Z^{(-)} \quad (1d)$$

$$ClCH_2-CH(OH)-CH_2-\overset{(+)}{N}R_2{}^1R^2Z^{(-)} \quad (1e)$$

where

Z is alkylen-(ER)-$_m$;

ER is an ester group;

A and N together with 1 or 2 alkylene groups of 1 to 4 carbon atoms form the radical of a heterocyclic ring wherein A is an oxygen atom or a group of the formula (a), (b) or (c)

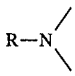

(a)

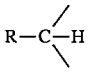

(b)

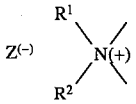

(c)

where

R is a hydrogen atom or an amino group or an alkyl group of 1 to 6 carbon atoms which is optionally substituted by 1 or 2 substituents selected from the group consisting of amino, sulfo, hydroxyl, sulfato, phosphato and carboxyl, or is an alkyl group of 3 to 8 carbon atoms which is interrupted by 1 or 2 hetero groups selected from the group consisting of —O— and —NH— and is optionally substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is an amino group of the formula $H_2N$— or an amino or ammonium group of the formula (d) or (e)

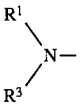

(d)

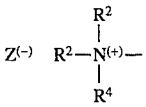

(e)

where $R^1$, $R^2$ and $Z^{(-)}$ are each as defined above, $R^3$ is methyl or ethyl, and $R^4$ is hydrogen, methyl or ethyl;

p is 1 or 2;

alkylen is a straight-chain or branched alkylene radical of 2 or 6 carbon atoms which is optionally substituted by 1 or 2 hydroxyl groups, or is a straight-chain or branched alkylene radical of 3 to 8 carbon atoms which is interrupted by 1 or 2 hetero groups selected from the group consisting of —O— and —NH—;

alk is a straight-chain or branched alkylene radical of 2 to 6 carbon atoms, or is a straight-chain or branched alkylene radical of 3 to 8 carbon atoms which is interrupted by 1 or 2 hetero groups selected from the group consisting of —O— and —NH—, m is 1 or 2;

n is from 1 to 4; and where the amino, hydroxyl and ester groups are bonded to a primary, secondary or tertiary carbon atom of the alkylene radical;

or wherein the modifier is selected from the group consisting of 2-oxo-1,3-oxazolidine, 4-aminoethyl-2-oxo-1,3-oxazolidine, 5-aminoethyl-2-oxo-1,3-oxazolidine, 4-(trimethylammoniomethyl)- 2-oxo-1,3-oxazolidine chloride, 5-(trimethylammoniomethyl)- 2-oxo-1,3-oxazolidine chloride and 1-(trimethylammoniomethyl)-ethylene carbonate chloride.

2. The modified rayon fiber of claim 1, wherein the amine is selected from the group consisting of N-(β-sulfatoethyl)piperazine, N-[β-(β'-sulfatoethoxy)ethyl]piperazine, N-(γ-sulfato-β-hydroxypropyl)piperidine, N-(γ-sulfato-β-hydroxylpropyl)pyrrolidine, N-β-sulfatoethylpiperidine, 2-sulfato- 3-hydroxy-1-aminopropane, 3-sulfato-2-hydroxy-1-aminopropane, 1-sulfato-3-hydroxy-2-aminopropane, 3-hydroxy-1-sulfato-2-aminopropane, 2,3-disulfato- 1-aminopropane or 1,3-disulfato-2-aminopropane, N-(2-sulfatoethyl)piperazine sulfate, glycidyltrimethylammonium chloride, aziridine and N-hydroxyethylaziridine.

3. The modified rayon fiber of claim 1, wherein the amine has a 3-chloro-2-hydroxypropyl radical.

4. The modified rayon fiber of claim 1, wherein the amine is added in an amount of 1 to 20 percent by weight, based on the cellulose content of the alkali cellulose material.

5. The modified rayon fiber of claim 1, wherein the amine is added in an amount of 1 to 8 percent by weight, based on the cellulose content of the alkali cellulose material.

6. The modified rayon fiber of claim 1, wherein the modified rayon fiber is spun by a viscose spinning process.

7. A process for producing a dyed or printed textile material composed of rayon fiber, which comprises adding a modifier to a cellulose solution and spinning fibers from the solution, or by adding a modifier to an alkali cellulose solution or material, xanthating and spinning fibers by the viscose spinning process, wherein the modifier is an amine of the formula (1a), (1b), (1d) or (1e)

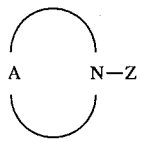

(1a)

$$(B)_p-\underset{\underset{(OH)_n}{|}}{alk}-(ER)_m \quad (1b)$$

$$CH_2-\overset{O}{\triangle}-CH-CH_2-\overset{(+)}{N}R_2{}^1R^2Z^{(-)} \quad (1d)$$

-continued $$ClCH_2-CH(OH)-CH_2-\overset{(+)}{N}R_2{}^1R^2Z^{(-)} \quad (1e)$$

where

Z is alkylene-(ER)-$_m$;

ER is an ester group;

A and N together with 1 or 2 alkylene groups of 1 to 4 carbon atoms form the radical of a heterocyclic ring wherein A is an oxygen atom or a group of the formula (a), (b) or (c)

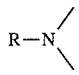

(a)

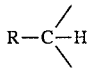

(b)

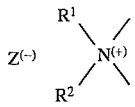

(c)

where

R is a hydrogen atom or an amino group or an alkyl group of 1 to 6 carbon atoms which is optionally substituted by 1 or 2 substituents selected from the group consisting of amino, sulfo, hydroxyl, sulfato, phosphato and carboyl, or is an alkyl group of 3 to 8 carbon atoms which is interrupted by 1 or 2 hetero groups selected from the group consisting of —O— and —NH— and is optionally substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

B is an amino group of the formula $H_2N$— or an amino or ammonium group of the formula (d) or (e)

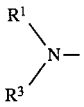

(d)

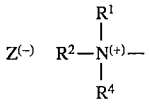

(e)

where $R^1$, $R^2$ and $Z^{(-)}$ are each as defined above, $R^3$ is methyl or ethyl, and $R^4$ is hydrogen, methyl or ethyl;

p is 1 or 2;

alkylen is a straight-chain or branched alkylene radical of 2 to 6 carbon atoms which is optionally substituted by 1 or 2 hydroxyl groups, or is a straigh-chain or branched alkylene radical of 3 to 8 carbon atoms which is interrupted by 1 or 2 hetero groups selected from the group consisting of —O— and —NH—;

alk is a straight-chain or branched alkylene radical of 2 to 6 carbon atoms, or is a straight-chain or branched alkylene radical of 3 to 8 carbon atoms which is interrupted by 1 or 2 hetero groups selected from the group consisting of —O— and —NH—, m is 1 or 2;

n is from 1 to 4; and where the amino, hydroxyl and ester groups are bonded to a primary, secondary or tertiary carbon atom of the alkylene radical;

or wherein the modifier is selected from the group consisting of 2-oxo-1,3-oxazolidine, 4-aminomethyl-2-oxo-1,3-oxazolidine, 5-aminomethyl-2-oxo-1,3-oxazolidine, 4-(trimethylammoniumethyl)- 2-oxo-1,3-oxazolidine chloride, 5-(trimethylammoniomethyl)-2-oxo-1,3-oxazolidine chloride and 1-(trimethylammoniomethyl)ethylene carbonate chloride, and forming said rayon fiber into a woven or knitted fabric and dyeing or printing said fabric with one or more anionic textile dyes without the further addition of electrolyte salt or alkali.

8. The process of claim 7, wherein the modified rayon fiber material is printed by the inkjet method.

9. The process as claimed in claim 7, wherein after the addition of said modifier, the reaction mixture is ripened for 15 minutes to 6 hours.

10. The process as claimed in claim 9, wherein the reaction mixture is ripened at a temperature of 40° to 80° C.

11. The process as claimed in claim 9, wherein the reaction mixture is ripened for 1 to 3 hours.

12. The process as claimed in claim 10, wherein the reaction mixture is ripened for 1 to 3 hours.

* * * * *